US005996301A

United States Patent [19]

Conterno

[11] Patent Number: 5,996,301

[45] Date of Patent: Dec. 7, 1999

[54] WALL PANEL ASSEMBLY

[75] Inventor: Cosimo Conterno, Via Municipio, Switzerland

[73] Assignee: Estruseone Materie Plastische, Switzerland

[21] Appl. No.: 08/978,921

[22] Filed: Nov. 26, 1997

[30] Foreign Application Priority Data

Mar. 20, 1997 [CH] Switzerland ..... 0670/97

[51] Int. Cl.[6] ..... E04B 1/02; E04C 3/30

[52] U.S. Cl. ..... 52/563; 52/413; 52/586.1; 52/582.1; 52/800.11

[58] Field of Search ..... 52/413, 772, 773, 52/774, 582.1, 586.2, 586.1, 800.1, 800.13, 800.17, 802.1, 563, 569, 570, 560, 562, 571, 762, 763, 581, 800.11

[56] References Cited

U.S. PATENT DOCUMENTS

| | | |
|---|---|---|
| 1,141,445 | 6/1915 | Davison . |
| 2,293,351 | 8/1942 | Meginnity . |
| 2,312,994 | 3/1943 | Weitzel . |
| 2,841,255 | 7/1958 | Kemp . |
| 3,002,591 | 10/1961 | Hess . |
| 3,022,869 | 2/1962 | Radek . |
| 3,046,852 | 7/1962 | Graham . |
| 3,257,758 | 6/1966 | Johnson . |
| 3,290,850 | 12/1966 | Byrne, Jr. et al. . |
| 3,299,595 | 1/1967 | Munk . |
| 3,348,459 | 10/1967 | Harvey . |
| 3,363,383 | 1/1968 | La Barge . |
| 3,386,221 | 6/1968 | Giovannucci . |
| 3,421,276 | 1/1969 | LaBarge . |
| 3,984,961 | 10/1976 | Cheeger et al. . |
| 4,035,539 | 7/1977 | Loboshez . |
| 4,057,936 | 11/1977 | Wyatt, Jr. et al. . |
| 4,084,272 | 4/1978 | Laven . |
| 4,193,232 | 3/1980 | Almsted et al. . |
| 4,223,493 | 9/1980 | Moench et al. . |
| 4,242,849 | 1/1981 | Benkelman et al. . |
| 4,299,070 | 11/1981 | Olimanns et al. . |
| 4,332,119 | 6/1982 | Toews . |
| 4,461,131 | 7/1984 | Pressell ..... 52/395 |
| 4,573,300 | 3/1986 | Bezner . |
| 4,998,395 | 3/1991 | Bezner ..... 52/563 |

FOREIGN PATENT DOCUMENTS

| | | |
|---|---|---|
| 0 006 431 | 1/1980 | European Pat. Off. . |
| 1007773 | 5/1952 | France . |
| 812130 | 12/1951 | Germany . |
| 1609777 | 4/1970 | Germany . |
| 1759662 | 6/1971 | Germany . |
| 7045759 | 6/1972 | Germany . |
| 2125725 | 12/1972 | Germany . |
| 2527013 | 1/1976 | Germany . |
| 7716036 | 10/1978 | Germany . |
| 2802181 | 7/1979 | Germany . |
| 482747 | 4/1938 | United Kingdom . |
| 814250 | 6/1959 | United Kingdom . |

*Primary Examiner*—Carl D. Friedman
*Assistant Examiner*—Yvonne Horton-Richardson
*Attorney, Agent, or Firm*—Pepe & Hazard LLP

[57] ABSTRACT

A panel assembly including two pairs of panels disposed in spaced parallel relationship lying in common planes with the coplanar panels of each pair having adjacent edges with similarly configured protrusions extending along their adjacent edges, and the protrusions on each of the panels of a pair extend towards each other. A connector is disposed between the pairs of panels and has a large recess in one face thereof which seats the protrusions on the panels disposed in one plane. The opposite face of the connector has a pair of spaced recesses therein which seat the protrusions on the panels disposed in the other plane.

17 Claims, 1 Drawing Sheet

WALL PANEL ASSEMBLY

BACKGROUND OF THE INVENTION

This invention concerns the construction of buildings and other structures, particularly the sector that utilizes panels, ordinarily fabricated of synthetic resins like polycarbonate and other polymers of similar properties, connected to one another to form walls.

Specifically, the invention is directed to an assembly in which a joint component connects four panels to form a double wall with an air space therebetween.

According to the present state of the technology, such an assembly is made using a connector that has been shaped on the inside to accommodate two projecting parts complementary to it on the facing edges of two abutting panels which are co-planar.

On the sides of the rear part of that connector, there are two grooves into which are inserted complementary shaped extensions on the two other panels so as to anchor the same in a co-planar manner with the connector between them.

Such a connector is a single-walled extrusion, and it must necessarily be made of metal and with sufficient thickness to provide the necessary rigidity and resistance to flexure.

Moreover, when the assembly has been made as just described, in order to remove one of the two panels with the shaped extensions without risk of damaging them, it is generally necessary to disassemble the entire joint, taking apart a portion of the wall which has been assembled.

It is an object of the present invention to provide a novel assembly of four panels and a synthetic resin connector.

It is also an object to provide such an assembly where two of the panels extending in one plane can be easily disassembled from the connector.

Another object is to provide such an assembly which may be readily constructed and which provides a rigid connection between the adjacent panels.

SUMMARY OF THE INVENTION

It has now been found that the foregoing and related objects may be readily attained in a panel assembly which includes a first pair of panels disposed in spaced parallel relationship and a second pair of panels disposed in spaced parallel relationship and lying in planes coplanar with those of the first pair of panels. The coplanar panels have adjacent edges with similarly configured protrusions extending along their adjacent edges, and the protrusions on each of said pairs of panels extend from the planes towards each other.

A connector is disposed between the pairs of panels and has a large recess in one face thereof which seats the protrusions on the panels disposed in one plane with the edges of the protrusions abutting each other. The opposite face of the connector has a pair of spaced recesses therein seating the protrusions on the panels disposed in the other plane.

The panels and the connector are fabricated from synthetic resin which is desirably translucent such as polycarbonate.

Preferably, the other face of the connector has edge portions and a center portion between the spaced recesses. The plane of the edge portions is offset from the plane of the center portion a distance equal to the thickness of the panels in the other plane so that the outer surfaces of the other panels and the center portion are substantially coplanar.

Desirably, the protrusions on the panels in the other plane are of generally L-shaped cross section with a resiliently deflectable bulb portion at the free end thereof. The recesses are of complementary cross section, and the bulb portions are compressible to permit seating of the protrusions in the recesses.

Preferably, the one face of the connector is planar and the marginal portions of the pair of panels in the one plane extend thereover to seat the protrusions in the recess. The protrusions in the pair of panels in said one plane have convex abutting edge surfaces provided on bulbous free ends.

Generally, the panels have a cross section including a pair of spaced skins providing inner and outer surfaces and ribs extending therebetween to provide structural strength and air spaces providing insulating properties. Moreover, the connector has internal ribs providing structural strength.

BRIEF DESCRIPTION OF THE DRAWINGS

We shall now give a more detailed description of a preferred form in which to make the connection for a panel assembly in accordance with the invention in which reference will also be made to the attached figures.

DETAILED DESCRIPTION OF THE PREFERRED EMBODIMENT

Figure 1:
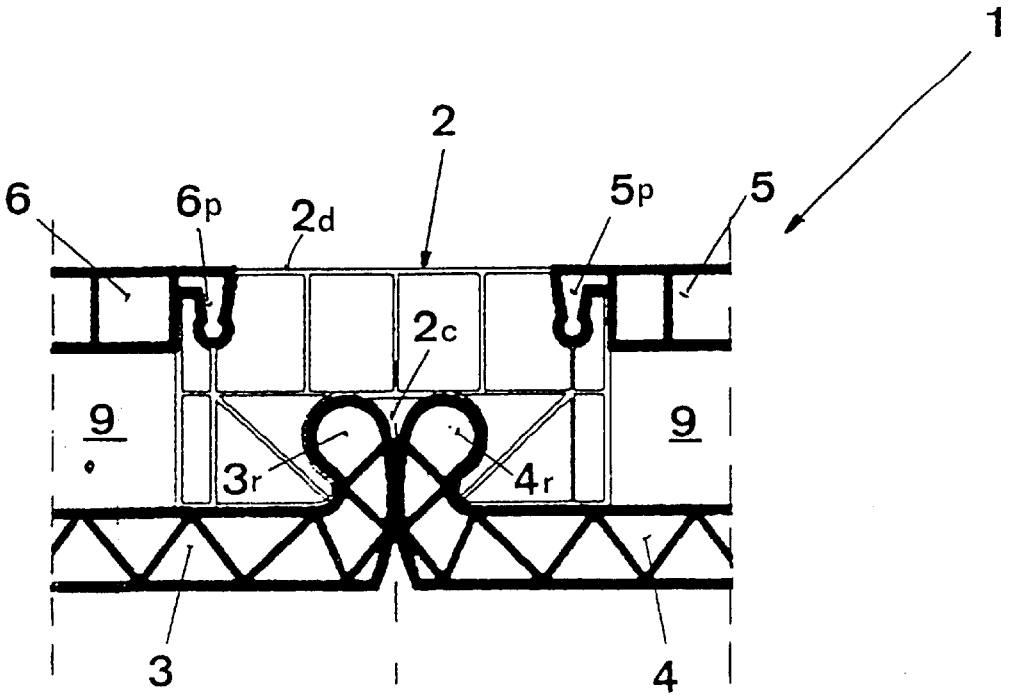
FIG. 1 is a fragmentary cross sectional view of a panel assembly embodying the present invention.
Figure 2:
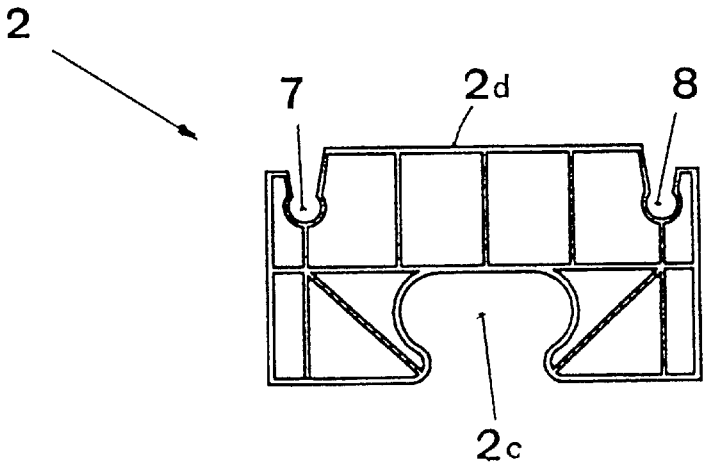
FIG. 2 is a cross sectional view of the connector of FIG. 1.

As seen in FIGS. 1 and 2, the panel assembly 1 is made up of a connector generally designated by the numeral 2 extends over the entire length of the panels 3, 4, 5 and 6 to be connected. In one face it has a large recess 2*c* of generally inverted U-shaped configuration. The recess 2*c* is complementary in configuration and dimensioned to the protrusions 3*r*, 4*r* on the edges of the two panels 3, 4 which seat therein to effect the desired connection. The protrusions 3*r*, 4*r* are bulbous and are resiliently compressible so as to enable their insertion into the recess 4*c*.

As best seen in FIG. 2, the connector 2 is a plastic extrusion with internal ribs 10 and having a width L relatively pronounced so as opportunely to increase the moment of inertia of its cross section, and hence its rigidity and its resistance to flexure.

On the rear surface 2*d* of the connector 2 there are two generally key-shaped recesses 7, 8 which extend perpendicular to its surface 2*d*. On the facing edges of the other two panels 5, 6 are protrusions 5*p*, 6*p* having a key-shaped profile complementary to that of the two recesses 7, 8. The protrusions 5*p*, 6*p* are resiliently compressible so that they are able to deflect to enter into the recesses 7, 8, and to be held therein. However, they can also be disengaged by applying sufficient force to produce deflection.

In this way there is formed an assembly 1 of four panels 3, 4, 5, 6 as parallel coplanar pairs to form a double wall with an air space 9 between them suitable for curtain walls. The connector 2 is light in weight and has the advantage of allowing the removal of one of the two panels 5, 6 by exerting on them a simple pulling action in a direction generally perpendicular to the face of connector 2, without having to make recourse to any other dismantling operation.

Above all, the two protrusions 5*p*, 6*p* work together with the connector 2 to resist flexural stresses.

The protrusions 5*p*, 6*p* can extend over the entire length of the edge of the respective panels 5, 6 or over only some portions thereof, depending on the type of use and on the expected stresses.

As will be appreciated, the panels and connector can be readily extruded in long lengths with the requisite configuration. Translucent resins such as polycarbonate enable them to provide strength and light transmission.

The form, size and relative positioning of the various parts making up the assembly according to the present invention can be modified to obtain configurations which differ from the one described and portrayed in the drawings. Also such assemblies, if derived from the concepts expressed in the attached claims, fall within the scope of the protection conferred by the present request for a patent.

Having thus described the invention, what is claimed is:

1. A panel assembly comprising:

(a) a first pair of panels disposed in spaced parallel relationship;

(b) a second pair of panels disposed in spaced parallel relationship and lying in planes coplanar with those of said first pair of panels, the coplanar panels having adjacent edges with similarly configured protrusions extending along their adjacent edges, said protrusions on each of said pairs of coplanar panels extending from said planes towards each other; and (c) a connector disposed between said pairs of panels and having a large recess in one face thereof seating the protrusions on the panels disposed in one plane with the edges of said protrusions abutting, the opposite face of said connector having a pair of spaced recesses in edge portions thereof seating said protrusions on the panels disposed in the other plane and a center portion between said edge portions lying in a plane spaced from that of said edge portions, jthe outer surface of said panels in said other plane being substantially coplanar with said center portion.

2. The panel assembly in accordance with claim 1 wherein said panels and said connector are fabricated from synthetic resin.

3. The panel assembly in accordance with claim 2 wherein said synthetic resin of said panels is translucent.

4. The panel assembly in accordance with claim 2 wherein said synthetic resin of said panels is polycarbonate.

5. The panel assembly in accordance with claim 1 wherein the plane of said edge portions being offset from the plane of said center portion a distance equal to the thickness of said panels in said other plane whereby the outer surfaces of said other panels and said center portion are substantially coplanar.

6. The panel assembly in accordance with claim 1 wherein said protrusions on said panels in said other plane are of generally L-shaped cross section with a resiliently deflectable bulb portion at the outer end of said protrusions and wherein said recesses are of complementary cross section, said bulb portions being compressible to permit seating of said protrusions in said recesses.

7. The panel assembly in accordance with claim 1 wherein said one face of said connector is planar and the adjacent edges of said pair of panels in said one plane adjacent said protrusions extend thereover to seat said protrusions in said recess.

8. The panel assembly in accordance with claim 7 wherein said protrusions in said pair of panels in said one plane have convex abutting edge surfaces.

9. The panel assembly in accordance with claim 8 wherein said protrusions have bulbous free ends.

10. The panel assembly in connection with claim 1 wherein said panels have a cross section including a pair of spaced skins providing inner and outer surfaces and ribs extending therebetween to provide structural strength and air spaces providing insulating properties.

11. The panel assembly in connection with claim 1 wherein said connector has internal ribs providing structural strength.

12. A panel assembly comprising:

(a) a first pair of panels disposed in spaced parallel relationship;

(b) a second pair of panels disposed in spaced parallel relationship and lying in planes coplanar with those of said first pair of panels, the coplanar panels having adjacent edges with similarly configured protrusions extending along their adjacent edges, said protrusions on each of said pairs of panels extending from said planes towards each other; and (c) a connector disposed between said pairs of panels and having a large recess in one face thereof seating the protrusions on the panels disposed in one plane with the edges of said protrusions abutting, said one face of said connector being planar and the adjacent edges of said pair of panels in said one plane adjacent said protrusions extending thereover to seat said protrusions in said recess, the opposite face of said connector having a pair of spaced recesses therein seating said protrusions on the panels disposed in the other plane, said opposite face of said connector having edge portions and a center portion between said spaced recesses, the plane of said edge portions being offset from the plane of said center portion a distance equal to the thickness of said panels in said other plane whereby the outer surfaces of said other panels and said center portion are substantially coplanar.

13. The panel assembly in accordance with claim 12 wherein said protrusions on said panels in said other plane are of generally L-shaped cross section with a resiliently deflectable bulb portion at the outer end of said protrusions and wherein said recesses are of complimentary cross section, said bulb portions being compressible to permit seating of said protrusions in said recesses.

14. The panel assembly in accordance with claim 12 wherein said protrusions in said pair of panels in said one plane have convex abutting edge surfaces.

15. The panel assembly in accordance with claim 12 wherein said protrusions have bulbous free ends.

16. The panel assembly in accordance with claim 12 wherein said panels and said connector are fabricated from polycarbonate resin.

17. The panel assembly in connection with claim 16 wherein said panels have a cross section including a pair of spaced skins providing inner and outer surfaces and ribs extending therebetween to provide structural strength and air spaces providing insulating properties, and wherein said connector has internal ribs providing structural strength.

* * * * *

UNITED STATES PATENT AND TRADEMARK OFFICE

CERTIFICATE OF CORRECTION

PATENT NO. :5,996,301
DATED :December 7, 1999
INVENTOR(S) :Conterno

It is certified that error appears in the above-identified patent and that said Letters Patent is hereby corrected as shown below:

On the title page, item [73] Assignee: should read -- Laminati Estrusi Termoplastici S.P.A.
Via dell Industria
22070 Figliaro/Como
Italy --

Signed and Sealed this

Twenty-seventh Day of March, 2001

*Attest:*

*Attesting Officer*

NICHOLAS P. GODICI

*Acting Director of the United States Patent and Trademark Office*